United States Patent [19]

Bowman

[11] 4,198,640

[45] Apr. 15, 1980

[54] REFLECTARRAY ANTENNA

[75] Inventor: David F. Bowman, Moorestown, N.J.

[73] Assignee: RCA Corporation, New York, N.Y.

[21] Appl. No.: 917,889

[22] Filed: Jun. 22, 1978

[51] Int. Cl.[2] ..... H01Q 3/26

[52] U.S. Cl. ..... 343/754; 343/768; 343/854

[58] Field of Search ..... 343/754, 755, 854, 767, 343/768, 769, 770, 771

[56] References Cited

U.S. PATENT DOCUMENTS

| | | | |
|---|---|---|---|
| 3,524,188 | 8/1970 | Bowman | 343/754 |
| 3,665,480 | 5/1972 | Fassett | 343/754 |

*Primary Examiner*—David K. Moore

*Attorney, Agent, or Firm*—H. Christoffersen; Joseph D. Lazar; Robert A. Hays

[57] ABSTRACT

A reflectarray antenna includes a primary feed that radiates a primary wave to a plurality of radiators where the wave is absorbed. A portion of the absorbed wave is resolved into first and second mutually orthogonal components at first and second feed ports, respectively, of a radiator. The first component is transmitted with a designated phase shift via a transmission phase shifter to the second feed port. Correspondingly, the second component is transmitted with the designated phase shift via the phase shifter to the first feed port. After the components are transmitted to the feed ports, they are re-radiated by the radiator in polarization states orthogonal to the ones in which they were absorbed.

12 Claims, 9 Drawing Figures

REFLECTARRAY ANTENNA

BACKGROUND OF THE INVENTION

1. Field of Invention

This invention is related to microwave radiation and more particularly to a reflectarray antenna.

2. Description of the Prior Art

A type of antenna, known as a reflectarray antenna, is comprised of an array of radiators, such as dipoles, spirals, or waveguides. The radiators are respectively connected to ones of a plurality of phase shifters that are controlled by a computer. The reflectarray antenna is illuminated by a primary wave from a primary feed.

The primary wave passes through the phase shifters, is reflected back to the radiators, and re-radiated into space. The re-radiated wave has a phase front determined by the phase shifters. Additionally, as well known in the art, the re-radiated wave has only one polarization state. In other words, the far field of the re-radiated wave has only one fixed direction of polarization. Accordingly, the reflectarray antenna has some of the features of a reflector and others of a directly fed phased array antenna. Reflectarray antennas are described in a technical article "The Reflectarray Antenna" by Berry, Malech and Kennedy (November, 1963 IEEE Transactions on Antennas and Propagation) and in Section 11.8 of *Radar Handbook* by M. I. Skolnik, 1970 published by McGraw Hill, Inc.

When the polarization state of the primary wave is selectable, it may be desired to have the polarization state of the re-radiated wave determined by the polarization state of the primary wave, thereby achieving polarization flexibility. The polarization flexibility is achieved when the radiators each have a pair of feed ports where an absorbed wave is resolved into components having mutually orthogonal polarization states. The feed ports of a radiator are connected, respectively, to a pair of phase shifters whereby the antenna includes two phase shifters for each radiator. The orthogonality of the polarization states of the pairs of elements causes the array to be capable of forming and steering a wave having a polarization determined by the polarization of the primary wave. However, cost and power comsumption associated with two phase shifters for each radiator may be prohibitive.

SUMMARY OF THE INVENTION

According to the present invention, a plurality of radiators of a reflectarray antenna absorb a primary wave of electromagnetic energy radiated by a primary feed, a portion of the wave being resolved at first and second feed ports of an exemplary radiator into mutually orthogonal first and second components, respectively. A reciprocal transmission phase shifter imparts a designated phase shift to the first component and transmits it to the second feed port. The phase shifter imparts the designated phase shift to the second component and transmits it to the first feed port. The phase shifted components are re-radiated by the radiator in polarization states orthogonal to the ones in which they were absorbed.

DESCRIPTION OF THE PREFERRED EMBODIMENT

Figure 1:
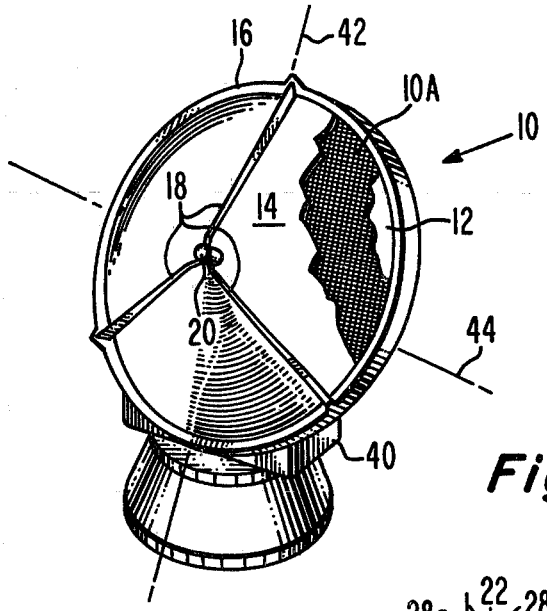
FIG. 1 is a pictorial view of a preferred embodiment of the present invention.
Figure 2:
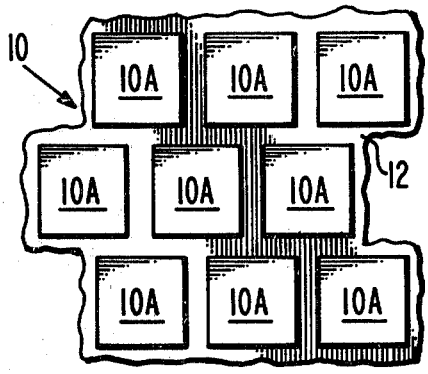
FIG. 2 is a plan view of part of an array of patches in the embodiment of FIG. 1.

Although many types of radiators are suitable for use in the present invention, the preferred embodiment of the invention utilizes metal patches. As shown in FIGS. 1 and 2, a reflectarray antenna 10 is comprised of an array of square metal patches 10A mounted upon a dielectric substrate 12 made, for example, from alumina. When antenna 10 operates in a 5.4 to 5.9 GHz frequency range, each of patches 10A is preferably 1.6 cm on a side. In this embodiment, patches 10A are covered by a suitable weather seal 14.

Substrate 12 is mounted within a frame 16 which is integral with a tripod 18 that supports a feed horn 20 connected to a radar (not shown) whereby excitation is applied to feed horn 20. In response to the excitation, a primary wave of electromagnetic energy having a selected one of a plurality of polarization states radiates from feed horn 20 to illuminate patches 10A. It should be understood that feed horn 20 is the primary feed of antenna 10.

As explained hereinafter, the primary wave is absorbed by patches 10A and re-radiated as a collimated wave with a desired pointing angle. Moreover, the re-radiated wave has a polarization state determined by the polarization state of the primary wave.

Figure 3:
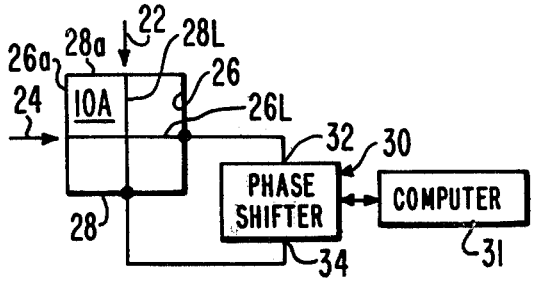
FIG. 3 is a first block diagram of a circuit for causing radiation from an exemplary patch in the array of FIG. 1.

Shown in FIG. 3 is an exemplary one of patches 10A that is illuminated by a portion of the primary wave. As explained hereinafter, exemplary patch 10A resolves the wave portion into two components having mutually orthogonal polarization states.

Exemplary patch 10A has opposed edges 26 and **26*a* connected at their midpoints by a line 26L. The wave portion is resolved into a first component that has a polarization state parallel to edges 26 and 26*a*. Moreover, the first component is provided by a feed port disposed at any point along line 28L, except at the point at the center of exemplary patch 10A**.

Similar, opposed edges 28 and **28*a* are connected at their midpoints by a line 28L. The wave portion is resolved into a second component having a polarization state parallel to edges 28 and 28*a*. Moreover, the second component is provided by a feed port disposed at any point along line 26L, except at the point at the center of exemplary patch 10A**.

The polarization state of the first component is represented by an electric field vector 22 which is parallel to edges 26 and 26*a*. The polarization state of the second component is represented by an electric field vector 24 orthogonal to vector 22 and parallel to edges 28 and 28*a*. Therefore, the first and second components have polarization states that are mutually orthogonal.

In this embodiment, ports at edges 26 and 28 are connected to a reciprocal transmission phase shifter 30 at ports 32 and 34 thereof, respectively. Phase shifter 30 is additionally connected to a computer 31 that provides a signal representation of a predetermined or designated phase shift. Preferably, phase shifter 30 and exemplary patch 10A are on opposite sides of substrate 12, thereby maintaining phase shifter 30 at a location where it does not occlude patches 10A.

The first component of the absorbed portion of the primary wave is transmitted with the designated phase shift via phase shifter 30 from edge 28 to edge 26. Correspondingly, the second wave component is transmitted with the designated phase shift via phase shifter 30 from edge 26 to edge 28. Phase shifter 30 is of a type described in the book, "Microwave Scanning Antennas," Volume 3, pages 102–120, by R. C. Hansen, published in 1966 by Academic Press. Phase shifter 30 may alternatively be of any other suitable reciprocal transmission type.

Because the first wave component is transmitted to edge 26 and the second wave component is transmitted to edge 28, the wave components are each re-radiated by exemplary patch 10A in a polarization state orthogonal to the one in which they were absorbed. When, for example, the wave components are of equal amplitude, the wave portion is re-radiated with a polarization state the same as the polarization state in which it was absorbed. However, when the wave components are of unequal amplitude, the wave portion is re-radiated with a polarization state determined by the relative magnitudes of the wave components. Therefore, the polarization state of the re-radiated wave portion is determined by the polarization state of the primary wave.

It should be understood that each of patches 10A is connected to a phase shifter similar to phase shifter 30 in the manner described hereinbefore. The phase shifts provided by the phase shifters cause patches 10A to re-radiate the primary wave in a collimated form with a desired pointing angle.

Although the preferred embodiment refers to horn 20 radiating the primary wave having the selected polarization state, it should be understood that the selected polarization state may be any desired polarization state. Alternatively, feed horn 20 may simultaneously radiate two primary waves having orthogonal polarization states. The two waves are each re-radiated in the manner described hereinbefore.

Figure 4:
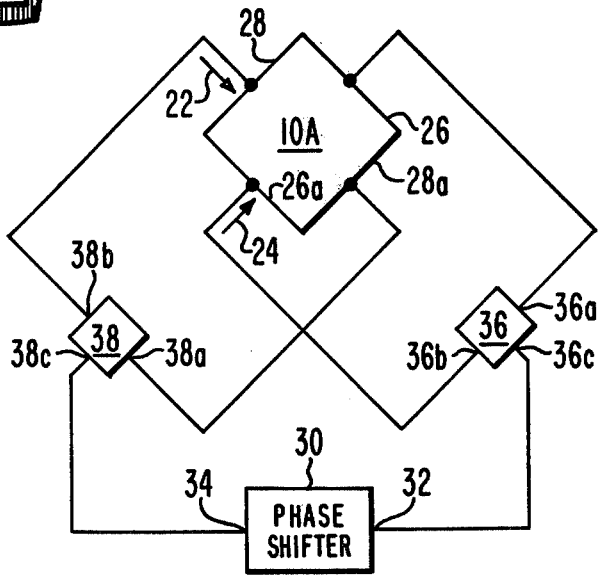
FIG. 4 is a second block diagram of a circuit for causing radiation from the exemplary patch.

As shown in FIG. 4, the bandwidth of exemplary patch 10A is increased by connecting the centers of opposite edges 26 and 26*a* of patch 10A to a balun 36 at respective balanced line ports 36*a* and 36*b* thereof. Correspondingly, the centers of opposite edges 28 and 28*a* are connected to a balun 38 at respective balanced line ports 38*a* and 38*b* thereof. Unbalanced line ports 36*c* and 38*c* of baluns 36 and 38 are connected, respectively, to ports 32 and 34.

Illumination of exemplary path 10A and re-radiation therefrom is similar to that described in connection with FIG. 3. Baluns, a shortened term derived from "BALanced-to-UNbalanced transformer," are well known in the art.

Although the transmitted wave has the desired pointing angle, coverage of antenna 10 is increased by mounting it upon a two axis pedestal 40 (FIG. 1) where servo motors (not shown) rotate antenna 10 about orthogonal axes 42 and 44 to a selected position.

Figure 5:
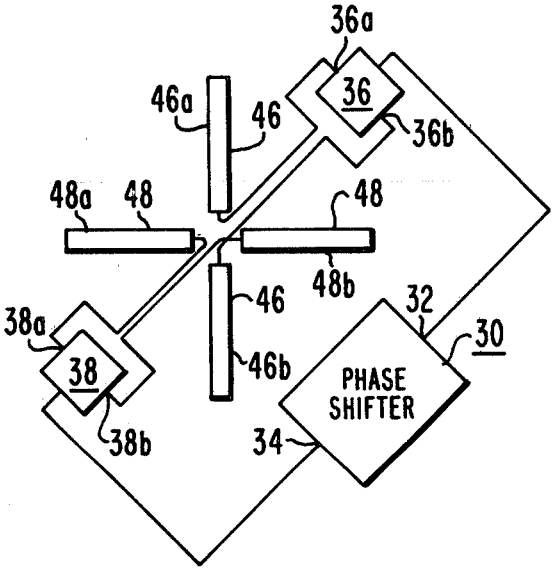
FIG. 5 is a block diagram of a circuit for causing radiation from a pair of crossed dipoles.

In one alternative embodiment, a reflectarray antenna includes an array of crossed dipoles. As shown in FIG. 5, dipoles 46 and 48 are disposed orthogonal to each other. Proximal ends of elements 46*a* and 46*b* of dipoles 46 are connected to balanced line ports 36*a* and 36*b*, respectively. Similarly, proximal ends of elements 48*a* and 48*b* of dipole 48 are connected to balanced line ports 38*a* and 38*b*, respectively. The dipoles absorb and re-radiate waves in a similar manner to that of patches 10A.

Figure 6:
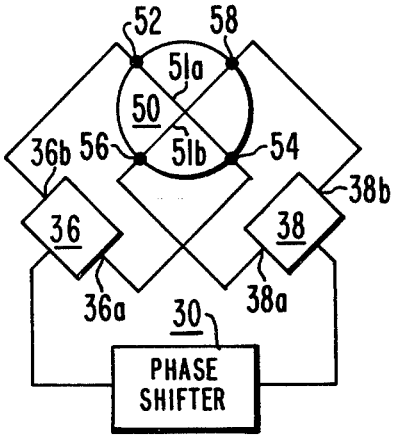
FIG. 6 is a block diagram of a circuit for causing radiation from a circular patch.

In another alternative embodiment, a reflectarray antenna includes an array of circular metal patches mounted on a dielectric substrate. As shown in FIG. 6, an exemplary patch 50 has a diameter 51*a*. The first component is provided by a feed port disposed at any point along diameter 51*a*, except at the point at the center of patch 50. Similarly, patch 50 has a diameter 51*b* which is orthogonal to diameter 51*a*. The second component is provided by a feed port disposed at any point along diameter 51*b*, except at the point at the center of patch 50.

In this embodiment, patch 50 has ports 52 and 54 at respective ends of diameter 51*a*. Correspondingly, patch 50 has ports 56 and 58 at respective ends of diameter 51*b*. Ports 52 and 54 are connected to ports 36*b* and 36*a*, respectively. Similarly, ports 56 and 58 are connected to ports 38*a* and 38*b*, respectively. Accordingly, re-radiation from patch 50 is analogous to re-radiation from exemplary patch 10 A described hereinbefore.

In other alternative embodiments, a reflectarray antenna includes an array of waveguides that are open at one end and closed at the other end. The primary wave is absorbed through the open ends of the waveguides.

Figure 7:
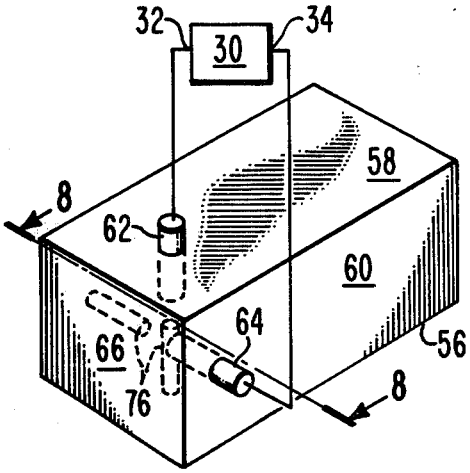
FIG. 7 is a pictorial block diagram of a circuit for causing radiation from a rectangular waveguide of a reflectarray.

As shown in FIG. 7, when the reflectarray antenna includes an array of rectangular waveguides, an exemplary rectangular waveguide 56 has perpendicular walls 58 and 60 connected to coaxial probes 62 and 64, respectively. Probe 62 is connected to port 32 and extends through wall 58. Correspondingly, port 64 is connected to port 34 and extends through wall 60. Probes 62 and 64 are preferably disposed approximately one quarter of a wavelength in waveguide 56 of the primary wave from an end wall 66 of waveguide 56. However, probe 64 is disposed closer to end wall 56 than probe 62.

Figure 8:
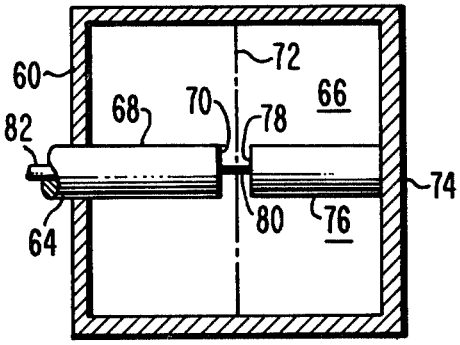
FIG. 8 is a sectional view of one end of the cavity of the waveguide of FIG. 7 through viewing lines 8—8.

As shown in FIG. 8, within the cavity of waveguide 56 the axis of probe 64 is perpendicular to wall 60. Additionally, outer conductor 68 of probe 64 has its end 70 adjacent to center plane 72 midway between wall 60 and a wall 74 of waveguide 56.

One end of a cylindrical metal port 76 is fixedly connected to wall 74, post 76 being coaxial with probe 64. Post 76 has an end 78 adjacent end 70, thereby forming a gap 80 therebetween. Center conductor 82 of probe 64 is connected to end 78, whereby gap 80 is bridged by conductor 82.

Probe 62 is connected to a post (not shown) similar to post 76. Because probe 64 is disposed closer to end wall 66 than probe 62, probe 62 is easily installed without an undesired contact between probes 62 and 64. It should be appreciated that because of gap 80 and a corresponding gap associated with probe 62, there is no undesired coupling between probes 62 and 64.

Figure 9:
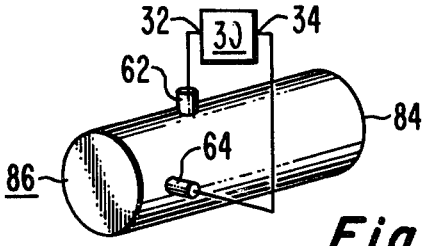
FIG. 9 is a pictorial block diagram of a circuit for causing radiation from a circular waveguide of a reflectarray antenna.

As shown in FIG. 9, when the reflectarray includes an array of circular waveguides, an exemplary waveguide 84 is provided with probes 62 and 64 with an arcuate separation of 90 degrees therebetween. Probes 62 and 64 are preferably provided approximately one quarter of a wavelength from an end wall 86 of waveguide 84, with probe 64 carried closer to end wall 86 than probe 62. The outer conductor of probes 62 and 64 are each adjacent to posts corresponding to those described hereinbefore.

Since these antennas are linear reciprocal devices, the invention described herein is useful both for transmitting and receiving modes of operation. Although the claims appended hereto are to an antenna in a transmitting mode of operation, it should be undersood that the antenna is useful in a corresponding receiving mode of operation.

What is claimed is:

1. A reflectarray antenna that includes a primary feed for radiating a wave having a selected one of a plurality of polarization states, said wave being absorbed by a plurality of radiators, the improvement comprising:

each radiator positioned to absorb a portion of said wave; and a plurality of reciprocal transmission phase shifters each associated with a different one of said radiators, each such phase shifter having first and second portions connected to a first feed port and a second feed port, respectively of the radiator with which it is associated, each received wave portion being resolved into a pair of components comprising first and second mutually orthogonal components at the first and second feed ports, respectively, of each radiator; and means for increasing the bandwith of said radiator by transforming said wave portions from an unbalanced state at said first and second ports to a balanced state at first and second feed feed ports respectively; and whereby each pair of first and second components have a designated phase shift and are provided to said second and first ports, respectively, in response to a signal representation of said designated phase shift.

2. The antenna of claim 1 wherein said primary feed simultaneously radiates said wave and an additional wave, said additional wave having a polarization state orthogonal to said selected one polarization state.

3. The antenna of claim 1 wherein each radiator is a rectangular conductive patch on a dielectric substrate.

4. The antenna of claim 1 wherein each radiator is a circular conductive patch on a dielectric substrate.

5. The antenna of claim 1 wherein each radiator is a pair of orthogonally disposed dipoles.

6. The antenna of claim 1 wherein each radiator is a rectangular waveguide.

7. The antenna of claim 1 wherein each radiator is a cylindrical waveguide.

8. The antenna of claim 1 wherein each said bandwidth increasing means comprises:

a first balun having balanced line ports connected to said first feed port, an unbalanced line port of said first balun being connected to said first port of said phase shifter; and a second balun having balanced line ports connected to said second feed port, an unbalanced line port of said second balun being connected to said second port of said phase shifters.

9. The antenna of claim 8 wherein each radiator is a rectangular conductive patch on a dielectric substrate.

10. The antenna of claim 8 wherein each radiator is a circular conductive patch on a dielectric substrate.

11. The antenna of claim 8 wherein each radiator is a pair of orthogonally disposed dipoles.

12. For use in a reflectarray antenna that includes a primary feed for radiating toward an array of radiators a wave having one or more selected ones of a plurality of polarization components, said wave being absorbed by said plurality of radiators, an improved element of said array comprising:

one of said radiators positioned to absorb a portion of said wave, said radiator having first and second feed ports; and a reciprocal transmission phase shifter having first and second portions connected to said first and second feed ports, respectively, of said radiator, said received wave portion being resolved into a pair of components comprising first and second mutually orthogonal components at said first and second feed ports, respectively, whereby said first and second components have a designated phase shift and are supplied to said second and first ports, respectively, via said reciprocal phase shifter in response to a signal representation of said designated phase shift and means for increasing the bandwith of said radiator by transforming said wave portions from an unbalanced state at said first and second ports to a balanced state at first and second feed feed ports respectively.

* * * * *